US008869373B2

(12) United States Patent
Glick et al.

(10) Patent No.: US 8,869,373 B2
(45) Date of Patent: Oct. 28, 2014

(54) ARBOR INSERTION TOOL

(75) Inventors: Michael Glick, Farmington Hills, MI (US); Slobodan Pavlovic, Novi, MI (US); Cecil Lamar Brown, II, Canton, MI (US); David Menzies, Linden, MI (US)

(73) Assignee: Lear Corporation, Southfield, MI (US)

( * ) Notice: Subject to any disclaimer, the term of this patent is extended or adjusted under 35 U.S.C. 154(b) by 867 days.

(21) Appl. No.: 13/080,753

(22) Filed: Apr. 6, 2011

(65) Prior Publication Data

US 2012/0000329 A1 Jan. 5, 2012

Related U.S. Application Data

(60) Provisional application No. 61/360,938, filed on Jul. 2, 2010, provisional application No. 61/364,922, filed on Jul. 16, 2010.

(51) Int. Cl.

| | |
|---|---|
| ***B25B 27/06*** | (2006.01) |
| ***H01R 13/187*** | (2006.01) |
| ***H01R 43/22*** | (2006.01) |
| *B25B 27/02* | (2006.01) |

(52) U.S. Cl.

CPC ..... *H01R 13/187* (2013.01); *H01R 43/22* (2013.01)

USPC ..... 29/525; 82/1.1

(58) Field of Classification Search

CPC ..... B25B 27/02; B25B 27/06; B25B 27/143; B25B 27/146

USPC ..... 82/1.11; 29/278, 525, 525.05

See application file for complete search history.

(56) References Cited

U.S. PATENT DOCUMENTS

| | | | | |
|---|---|---|---|---|
| 1,501,815 | A * | 7/1924 | Seppmann | 29/275 |
| 3,151,330 | A * | 10/1964 | Scuccimarri | 227/140 |
| 4,291,941 | A * | 9/1981 | Melzer | 385/74 |
| 4,640,114 | A * | 2/1987 | Kuless | 72/20.2 |
| 5,139,276 | A | 8/1992 | Balsells | |
| 5,203,813 | A | 4/1993 | Fitzsimmons et al. | |
| 5,358,224 | A | 10/1994 | Balsells | |

(Continued)

FOREIGN PATENT DOCUMENTS

| | | | |
|---|---|---|---|
| DE | 1590124 | B2 | 3/1970 |
| DE | 3702012 | A1 | 8/1987 |
| DE | 4315491 | A1 | 11/1994 |
| JP | 5919643 | A | 2/1984 |

OTHER PUBLICATIONS

German Office Action for Application No. 10 2011 078 350.4, mailed Oct. 10, 2013, 7 pages.

*Primary Examiner* — Will Fridie, Jr.
(74) *Attorney, Agent, or Firm* — Brooks Kushman P.C.

(57) ABSTRACT

An arbor operably configured to facilitate positioning an element within an open end of a terminal or other device. The arbor may be operable to position the element relative to a groove or another type of difficult to reach area interior the open end. The arbor may include an assembly operable to move the element through the open end to a desired position where the element is freed to be positioned within the groove or other portion of the open end. Optionally, in the event the element is resilient, the resiliency of the element may be relied upon to cause the element to free itself from the arbor using expansion and at the same time secure itself within the groove or other portion of the open end.

18 Claims, 4 Drawing Sheets

(56) References Cited

U.S. PATENT DOCUMENTS

| | | | |
|---|---|---|---|
| 5,474,309 | A | 12/1995 | Balsells |
| 5,599,027 | A | 2/1997 | Balsells |
| 6,752,668 | B2 | 6/2004 | Koch, Jr. |
| 6,835,084 | B2 | 12/2004 | Poon et al. |
| 7,191,518 | B2 | 3/2007 | Beloritsky et al. |
| 2004/0245686 | A1 | 12/2004 | Balsells |
| 2005/0242910 | A1 | 11/2005 | Balsells |
| 2008/0246231 | A1 | 10/2008 | Sjostedt et al. |
| 2008/0254670 | A1 | 10/2008 | Balsells et al. |
| 2008/0255631 | A1 | 10/2008 | Sjostedt et al. |
| 2009/0048638 | A1 | 2/2009 | Rey et al. |
| 2009/0258519 | A1 | 10/2009 | Dilmaghanian et al. |
| 2010/0029127 | A1 | 2/2010 | Sjostedt |
| 2010/0029145 | A1 * | 2/2010 | Balsells et al. ..... 439/827 |
| 2010/0279558 | A1 | 11/2010 | Leon et al. |

* cited by examiner

ARBOR INSERTION TOOL

CROSS-REFERENCE TO RELATED APPLICATIONS

This application claims the benefit of U.S. provisional Application No. 61/360,938 filed Jul. 2, 2010, entitled Electrical Terminal with Coil Spring, and U.S. provisional Application No. 61/364,922 filed Jul. 16, 2010, entitled Electrical Terminal with Coil Spring, the disclosures of which are incorporated in their entirety by reference herein.

TECHNICAL FIELD

The present invention relates to electrical terminals, such as but not limited to terminals of the type having coils springs operable to facilitate electrical connectivity between the terminal and one or more electrical connectors.

BACKGROUND

Electrical terminals are used in a number of applications to facilitate electrical connections between one element and another. Some electrical terminals may be configured to facilitate use with a removable connector of the type that may be repeatedly inserted and removed from electrical engagement with the electrical terminal. The ability of the electrical terminal to facilitate electrical connectivity with such a removable connector can be problematic if an electrical connection area between the terminal and connector has poor connectivity, particularly when tolerance variations or degradation from repeated use causes a mating arrangement between the components to become loose or otherwise insecure.

U.S. patent application Ser. Nos. 13/070,576 and 13/073,478, the disclosures of which are incorporated in their entirety by reference herein, propose solutions to the problematic issues associated with poor connectivity with the use of an element to provide an interference fit between the terminal and the connector through which connectivity may be improved over designs that do not include such an element or other insertable feature to facilitate connectivity. The positioning of the element within the terminal may be problematic, such as if the element is to be positioned within a recess or other hidden position interior to an open end of the terminal, particularly if an opening leading to the recess is smaller than the recess such that compression of other stamping of the element is required in order to align the element to the recess.

SUMMARY

One non-limiting aspect of the present invention relates to a tool suitable for use in position a resilient element or non-resilient element interior to an open end of an electrically conducting terminal, such as within a groove, recess, or other position specific location.

One non-limiting aspect of the present invention relates to an arbor operable to insert an element within an groove formed interior to an open end of an electrically conducting terminal, the element being shaped to delimit an opening sufficient to provide an interference fit with an connector inserted within the open end of the electrically conducting terminal. The arbor may include: a mandrel configured to secure the element at a first position; and a sliding assembly operable to slide the element at least partially along the mandrel from the first position to a second position, the second position positioning the element into alignment with the groove such that the element is freed to be retained within the groove.

One non-limiting aspect of the present invention relates to a diameter of an outer perimeter of the element decreasing while sliding along the mandrel from the first position to the second position.

One non-limiting aspect of the present invention relates to the diameter of the outer perimeter of the element becoming less than a smallest diameter of the open end outboard of the groove.

One non-limiting aspect of the present invention relates to a diameter of the groove being greater than the smallest diameter of the open end outboard of the groove such that the element expands into the groove once slid to the second position.

One non-limiting aspect of the present invention relates to a diameter of the mandrel at the second position being shaped to be narrower than a diameter of the mandrel at the first position in order to allow the outer perimeter of the element to decrease while sliding along the mandrel from the first position to the second position.

One non-limiting aspect of the present invention relates to the sliding assembly including: a collar operable to slide the element from the first position to a third position along the mandrel; and a plunger operable to slide the element from at least the third position to the second position.

One non-limiting aspect of the present invention relates to a smallest diameter of the open end outboard of the groove being less than a diameter of an outer perimeter of a portion of the collar configured to be inserted within the open end during insertion of the element.

One non-limiting aspect of the present invention relates to a diameter of an outer perimeter of a portion of the plunger being configured to be inserted within the open end during insertion is less than the smallest diameter of the open end outboard of the groove.

One non-limiting aspect of the present invention relates to each of the collar and the plunger completely surrounding an outer perimeter of the mandrel when positioned proximate the first position.

One non-limiting aspect of the present invention relates to an arbor operable to insert a coil spring within an open end of an electrically conducting terminal. The arbor may include: a mandrel configured to secure the coil spring at a first position prior to the mandrel being positioned within the open end; and an assembly operable to move the coil spring from the first position to a second position after the mandrel is positioned within the open end, the second position freeing the coil spring from the mandrel such that the coil spring remains in the open end upon removal of the mandrel.

One non-limiting aspect of the present invention relates to the mandrel being shaped to allow the coil spring is to compress when being moved from the first position toward the second position and then to at least partially decompress after reaching the second position to be secured within the open end.

One non-limiting aspect of the present invention relates to a shape of the mandrel forward of the first position narrowing to allow the coil spring to be freed after reaching the second position.

One non-limiting aspect of the present invention relates to the assembly including a collar configured to move the coil spring from the first position to a third position and a plunger configured to move the coil from the third position to the second position.

One non-limiting aspect of the present invention relates to a diameter of the collar being greater than a smallest diameter of the open end outboard of the groove, thereby preventing the collar from moving the coil spring from the third position to the second position.

One non-limiting aspect of the present invention relates to a method of positioning a resilient element within a recess formed interior to an open end of a terminal. The method may include: retaining the resilient element on a portion of a mandrel corresponding with a first position; positioning the mandrel within the open end of the terminal such that a portion of the mandrel corresponding with a second position is aligned with the recess; and sliding the resilient element along the mandrel from the first position to the second position, the resilient element at least partially decompressing upon reaching the second position to force the spring to be engaged within the recess.

One non-limiting aspect of the present invention relates to the first position being exterior to the open end.

One non-limiting aspect of the present invention relates to the resilient element maintaining an interference fit with the mandrel while sliding from the first position to the second position.

One non-limiting aspect of the present invention relates to an inner diameter of the resilient element decreasing while the resilient element slides from the first position to the second position.

One non-limiting aspect of the present invention relates to the resilient element being a coil spring having a plurality of coils of equal diameter, wherein the diameter of the plurality of coils, after the coil spring is positioned within the open end, remaining constant while the inner diameter decreases.

One non-limiting aspect of the present invention relates to sliding the resilient element from the first position to an intermediate position between the first position and the second position using a collar attached to the mandrel, the collar being too large to extend far enough within the open end to position the resilient element into alignment with the recess.

One non-limiting aspect of the present invention relates to sliding the resilient element from the intermediate position to the second position using a plunger attached to the mandrel, the plunger being small enough to extend sufficiently far into the open end to position the resilient element into alignment with the recess.

BRIEF DESCRIPTION OF THE DRAWINGS

The present invention is pointed out with particularity in the appended claims. However, other features of the present invention will become more apparent and the present invention will be best understood by referring to the following detailed description in conjunction with the accompany drawings in which:

DETAILED DESCRIPTION

Figure 1:
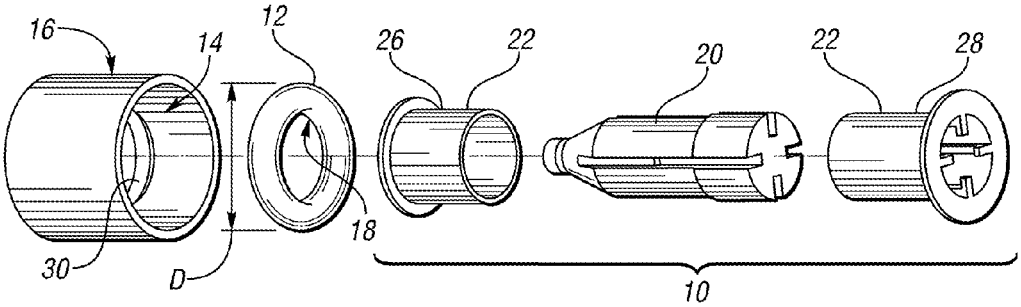
FIG. 1 illustrates an exploded view of an arbor as contemplated by one non-limiting aspect of the present invention.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

FIGS. 1-9 illustrates an arbor 10 as contemplated by one non-limiting aspect of the present invention to facilitate position an element 12 within an open end 14 of an electrically conducting terminal 16. The element 12 may include an internal opening 18 through which a connector (not shown) can extend when properly inserted within the open end 14 after the arbor 10 positions the element 12 within the open end 15. The element 12 may be a resilient element comprised of a conducting material and operable to enhance electrical connectivity between the connector and terminal 16 such as by preventing tolerance variations or degradation from repeated use from causing the electrical connection area between the terminal 16 and inserted connector from becoming loose or otherwise insecure.

The arbor 10 may include a mandrel 20 and sliding assembly 22 having a collar 26 and a plunger 28 cooperatively configured to impart movement to the element 12. The mandrel 20 may be configured to provide a support structure about which the sliding assembly 22 slides to facilitate positioning the resilient element 12 relative to a groove 30. The positioning of the resilient element 12 may be performed in a continuous or multi-stage operation where the resilient element 12 is positioned on the mandrel 20 at a first position (see FIG. 2) and then, after positioning the mandrel 20 within the open end 14 of the terminal 16, slid to a second position (see FIG. 9) at which the resilient element 12 is freed to expand into the groove 30.

Figure 2:
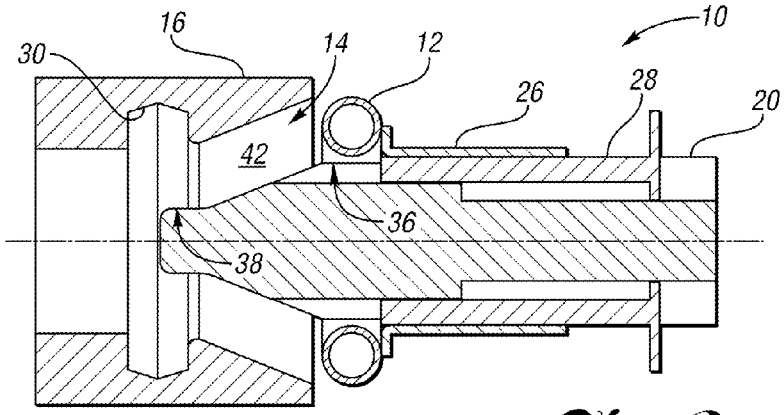
FIGS. 2-9 illustrate a cross-sectional view of the arbor and a sliding movement of an inserted element as contemplated by one non-limiting aspect of the present invention.
Figure 3:
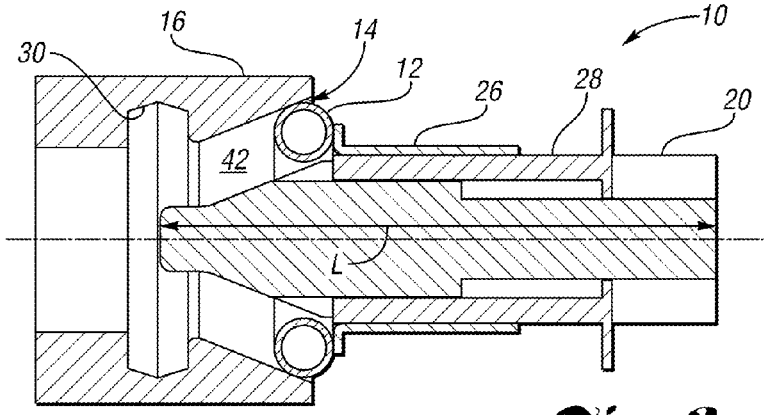
Figure 4:
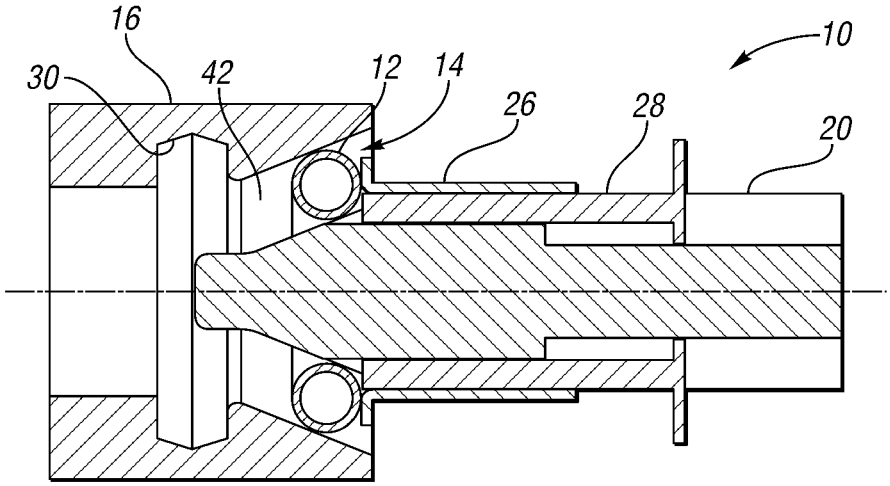
Figure 5:
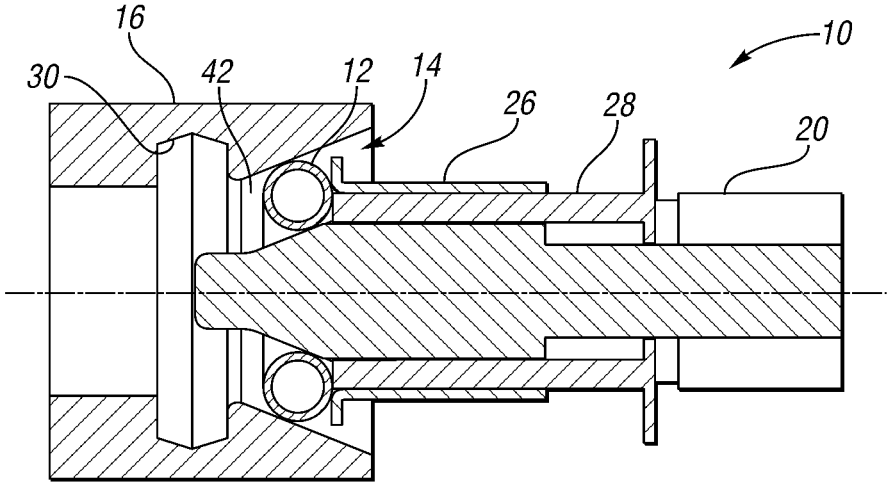
Figure 6:
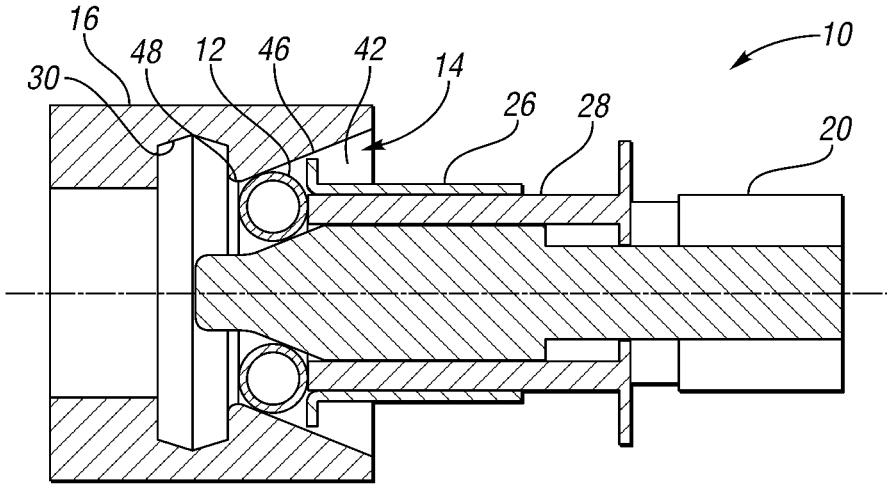
Figure 7:
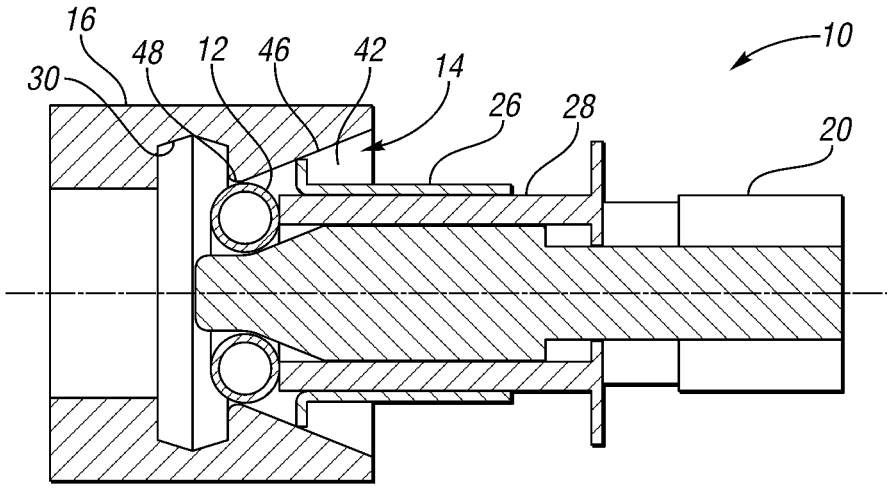
Figure 8:
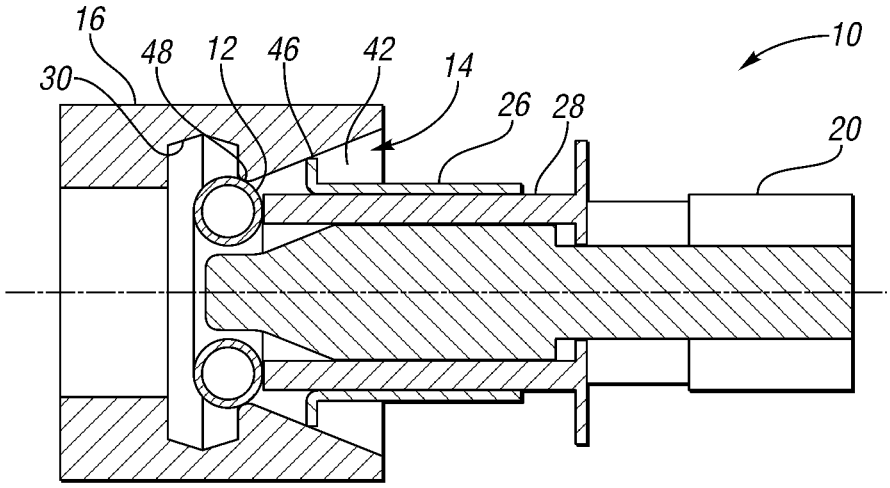
Figure 9:
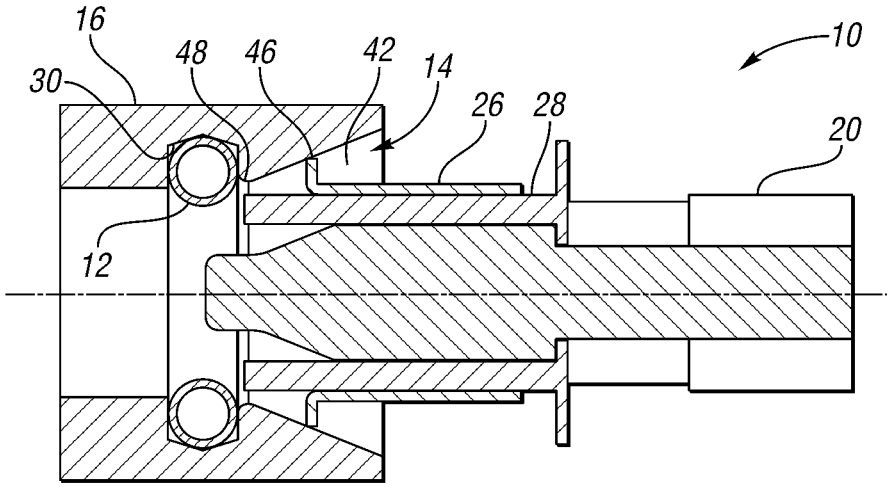

The mandrel 20 may be shaped to generally narrow from a portion 36 corresponding with the first position to a portion 38 corresponding with the second position. FIG. 2 shows the mandrel 20 to have a generally conical shaped throughout the narrowing between the portions 36, 38. An axial length L of the mandrel 20 may be sufficient to allow the resilient element 12 to be positioned at the first portion 36 and a forward or inboard end of the mandrel 20 to extend sufficiently far into the open end such that the second portion 38 is aligned with the groove 30. A width or diameter of mandrel from the first portion, through the narrowing portion, and to the second portion may be shaped to correspond with a corresponding portion of the open end 14 such that a uniform gap 42 is provided therebetween.

The mandrel shaping may also be configured to facilitate generating an interference fit with the resilient element 12. The interference fit at the first portion 26 may be caused by the resilient element 12 being slightly expanded from a relaxed position such that it applies a normal force to the mandrel 20. Thereafter, the resilient element 12 may be compressed after being positioned within the open end 14 (see FIGS. 3-8) and slid by the sliding element 22 toward the second position 38. The compression of the resilient element 12 may be characterized by an inner diameter or width of the opening 18 decreasing as the resilient element 12 travels from the first position to the second position. Optionally, in the event the resilient element 12 is a coil spring having a plurality of coils of equal diameter, the corresponding shaping of the open end 14 and mandrel 20 may allow the diameter of the individual coils to remain constant as the coil spring 12 is slid. A laterally spacing between the coils may be reduced during the sliding movement to permit the inner diameter to decrease.

The collar 26 may be configured to initially slide the resilient element 12 from the first position to a third or intermediate position (See FIGS. 6 and 7) where a width of the collar 26 causes it to contact a side 46 of the open end. Thereafter, the plunger 28, having a width smaller than a smallest width of a portion 48 of the side outboard 46 of the grove 30, may be configured to continue to slide the resilient element 12 to the second position so it can be freed to expand for securement within the groove. An outer diameter D of the resilient element 12 may be sized to control an amount of force applied by the resilient element against the terminal 16. An actuator (not show), such as spring, press, or combination of other devices may be used to facilitate the contemplated positioning of the mandrel 20 within the open end 14, such as through the two-stage movement of the collar 26 and the plunger 28. This process may be completed with manual force being applied to the arbor 10 and/or through a computer-controlled automated process where a robot, press, or other suitably operable device is operable to automatically position the resilient element 12 in the contemplated manner according to instructions stored within a computer-readable medium (not shown) and processed with a processor (not shown).

The foregoing arbor 10 is predominately described with respect to being configured to facilitate insertion of a coil spring 12 within the terminal 16 for exemplary purposes only. The present invention fully contemplates the arbor 16 being configured and used to facilitate positioning of resilient and/or non-resilient element 12 of any size, shape, and configuration within the terminal 16. The resilient element 12 may be any other type of conducting element operable to facilitate establishing and/or enhancing the electrical interconnection between the terminal 16 and the inserted connector. Other such conducting elements may include a conducting elastomer having suspending micro-wires, braided element, etc.

The arbor 10 is also predominately described with respect to being configured to facilitate insertion of the coil spring 12 within the groove 30 of the terminal 16 for exemplary purposes only as the present invention fully contemplates positioning the element 12 within non-recessed positions or other locations within the terminal 16. The positioning of the resilient element 12 within the groove 30 is believed to be particularly problematic since the resilient element 12 has an outer perimeter/diameter that is larger than the smallest portion 48 of the open end 14, making it impossible to insert the resilient element without it being compressed or otherwise shaped during insertion.

The compression of the resilient element 12 as contemplated by one non-limiting aspect of the present invention is provided by pushing a reward, side quadrant of the resilient element 12 into contact with the side 46 of the open end 14 such the side 46 of the open end 14 forces an outer perimeter/diameter D of the resilient element 12 to decrease. While the present invention fully contemplates compressing the resilient element 12 in another manner, such as with forceps or some other element operable to engage a top side quadrant of the resilient element 12 in a gripping motion, it is believed that such devices would have a more difficult process when trying to free the resilient element 12 to expand into the groove 30 as the forceps would be placed between the side 46 of the open end 14/groove 30 and the resilient element 12, requiring a quick retraction or other complex movement to remove itself as an obstacle to the resilient element 12 expanding into the groove 30.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An arbor operable to insert an element within a groove formed interior to an open end of an electrically conducting terminal, the element being shaped to delimit an opening sufficient to provide an interference fit with a connector inserted within the open end of the electrically conducting terminal, the arbor comprising:

a mandrel configured to secure the element at a first position; and a sliding assembly operable to slide the element at least partially along the mandrel from the first position to a second position, the second position positioning the element into alignment with the groove such that the element is freed to be retained within the groove, the sliding assembly including a collar operable to slide the element from the first position to a third position along the mandrel, and a plunger operable to slide the element from at least the third position to the second position.

2. The arbor of claim 1 wherein a diameter of an outer perimeter of the element decreases while sliding along the mandrel from the first position to the second position.

3. The arbor of claim 2 wherein the diameter of the outer perimeter of the element becomes less than a smallest diameter of the open end outboard of the groove.

4. The arbor of claim 3 wherein a diameter of the groove is greater than the smallest diameter of the open end outboard of the groove such that the element expands into the groove once slid to the second position.

5. The arbor of claim 3 wherein a diameter of the mandrel at the second position is shaped to be narrower than a diameter of the mandrel at the first position in order to allow the outer perimeter of the element to decrease while sliding along the mandrel from the first position to the second position.

6. The arbor of claim 1 wherein a smallest diameter of the open end outboard of the groove is less than a diameter of an outer perimeter of a portion of the collar configured to be inserted within the open end during insertion of the element.

7. The arbor of claim 6 wherein a diameter of an outer perimeter of a portion of the plunger configured to be inserted within the open end during insertion is less than the smallest diameter of the open end outboard of the groove.

8. The arbor of claim 1 wherein each of the collar and the plunger completely surround an outer perimeter of the mandrel when positioned proximate the first position.

9. An arbor operable to insert a coil spring within an open end of an electrically conducting terminal, the arbor comprising:

a mandrel configured to secure the coil spring at a first position prior to the mandrel being positioned within the open end; and an assembly operable to move the coil spring from the first position to a second position after the mandrel is positioned within the open end, the second position freeing the coil spring from the mandrel such that the coil spring remains in the open end upon removal of the mandrel, the assembly including a collar configured to move the coil spring from the first position to a third position and a plunger configured to move the coil from the third position to the second position.

10. The arbor of claim 9 wherein the mandrel is shaped to allow the coil spring to compress when being moved from the first position toward the second position and then to at least partially decompress after reaching the second position to be secured within the open end.

11. The arbor of claim 10 wherein a shape of the mandrel forward of the first position narrows to allow the coil spring to be freed after reaching the second position.

12. The arbor of claim 9 wherein a diameter of the collar is greater than a smallest diameter of the open end outboard of the groove, thereby preventing the collar from moving the coil spring from the third position to the second position.

13. A method of positioning a resilient element within an recess formed interior to an open end of a terminal, the method comprising:

retaining the resilient element on a portion of a mandrel corresponding with a first position;

positioning the mandrel within the open end of the terminal such that a portion of the mandrel corresponding with a second position is aligned with the recess; and sliding the resilient element along the mandrel from the first position to the second position, the resilient element at least partially decompressing upon reaching the second position to force the spring to be engaged within the recess.

14. The method of claim 13 wherein the first position is exterior to the open end.

15. The method of claim 13 wherein the resilient element maintains an interference fit with the mandrel while sliding from the first position to the second position.

16. The method of claim 13 wherein an inner diameter of the resilient element decreases while the resilient element slides from the first position to the second position.

17. The method of claim 16 wherein the resilient element is a coil spring having a plurality of coils of equal diameter, wherein the diameter of the plurality of coils, after the coil spring is positioned within the open end, remains constant while the inner diameter decreases.

18. The method of claim 13 wherein sliding the resilient element from the first position to the second position includes:

sliding the resilient element from the first position to an intermediate position between the first position and the second position using a collar attached to the mandrel, the collar being too large to extend far enough within the open end to position the resilient element into alignment with the recess; and sliding the resilient element from the intermediate position to the second position using a plunger attached to the mandrel, the plunger being small enough to extend sufficiently far into the open end to position the resilient element into alignment with the recess.

* * * * *